US007093468B2

(12) United States Patent
Song

(10) Patent No.: US 7,093,468 B2
(45) Date of Patent: Aug. 22, 2006

(54) KEY RING

(76) Inventor: Chang Woo Song, 400-6, JinKwan Nae-dong, Eunpyung-gu, Seoul 122-934 (KR)

( * ) Notice: Subject to any disclaimer, the term of this patent is extended or adjusted under 35 U.S.C. 154(b) by 0 days.

(21) Appl. No.: 10/250,846

(22) PCT Filed: Jan. 7, 2002

(86) PCT No.: PCT/KR02/00024

§ 371 (c)(1),
(2), (4) Date: Jul. 7, 2003

(87) PCT Pub. No.: WO02/054922

PCT Pub. Date: Jul. 18, 2002

(65) Prior Publication Data

US 2004/0050124 A1 Mar. 18, 2004

(30) Foreign Application Priority Data

Jan. 10, 2001 (KR) ..... 20-2001-0229737

(51) Int. Cl.
*A44B 15/10* (2006.01)

(52) U.S. Cl. ..... 70/457; 70/458; 24/3.6

(58) Field of Classification Search ..... 70/456 R, 70/456 B, 457, 458, 459, 460; 24/3.6; 206/37.1, 206/37.6, 37.8, 38.1; D3/207, 208, 210
See application file for complete search history.

(56) References Cited

U.S. PATENT DOCUMENTS

| | | | | | |
|---|---|---|---|---|---|
| 345,407 | A | * | 7/1886 | Besse | 70/458 |
| 448,892 | A | * | 3/1891 | Staiger | 63/15.4 |
| 603,247 | A | * | 5/1898 | Becker | 70/458 |
| 932,787 | A | * | 8/1909 | Kirby | 70/458 |
| 1,110,873 | A | * | 9/1914 | Boye | 70/458 |
| 1,419,408 | A | * | 6/1922 | Polhemus | 24/3.6 |
| 1,462,205 | A | * | 7/1923 | Korns | 70/458 |
| 1,817,246 | A | * | 8/1931 | Gardine | 70/458 |
| 2,286,265 | A | * | 6/1942 | Davio | 70/456 R |
| 2,292,563 | A | * | 8/1942 | Imhoff | 70/458 |
| 2,410,951 | A | * | 11/1946 | Kuhnl | 70/458 |
| 5,367,896 | A | * | 11/1994 | Sundberg | 70/457 |
| 5,722,277 | A | * | 3/1998 | Williams | 70/456 R |
| 5,842,365 | A | * | 12/1998 | Bordonaro | 70/456 R |
| 6,092,405 | A | * | 7/2000 | Berwick | 70/408 |

(Continued)

FOREIGN PATENT DOCUMENTS

| | | | | |
|---|---|---|---|---|
| AT | 25446 | * | 8/1906 | 70/458 |

(Continued)

*Primary Examiner*—Lloyd A. Gall
(74) *Attorney, Agent, or Firm*—Ladas & Parry LLP

(57) ABSTRACT

This present invention is related to a key ring for keeping a key. The key ring includes a ring body, which has cut planes at both ends thereof. A concave portion (30) is formed at a predetermined place of the key ring (10) and is curved in a direction and in a body with the key ring (10). One of the cut planes is projected toward an inner side of the concave portion (30), and the key (40) is inserted into the ring body (10). With this configuration, it is easy to keep and take out a key by less force by forming a concave portion at a predetermined position of a ring body made of a metallic material and making one cut plane at one end of the concave portion so as to be projected toward an inner side of the concave portion and the other cut plane so as to correspond to the other end of the concave portion.

1 Claim, 6 Drawing Sheets

U.S. PATENT DOCUMENTS

| | | | | | |
|---|---|---|---|---|---|
| 6,098,327 | A * | 8/2000 | Gallant | ..... | 40/634 |
| 2001/0018838 | A1* | 9/2001 | Perthou | ..... | 70/456 R |

FOREIGN PATENT DOCUMENTS

| | | | | | |
|---|---|---|---|---|---|
| FR | 455207 | * | 7/1913 | ..... | 70/458 |
| FR | 475273 | * | 5/1915 | ..... | 70/458 |
| FR | 491299 | * | 1/1919 | ..... | 70/458 |
| GB | 6959 | * | 0/1886 | ..... | 70/458 |
| GB | 23764 | * | 0/1913 | ..... | 70/456 R |
| GB | 210237 | * | 1/1924 | ..... | 70/458 |
| JP | 57 68684 | | 4/1982 | | |
| JP | 60 138482 | | 9/1985 | | |
| KR | 1983 0001268 | | 10/1983 | | |

* cited by examiner

KEY RING

FIELD OF THE INVENTION

The present invention is related to a key ring. In particular, the invention is related to a key ring for making it easy to join and disjoin a key by less strength and to prevent hurt of a user, by forming a concave portion at a predetermined position of a ring body and making one cut plane at one end of the concave portion so as to be projected toward an inner side of the concave portion and the other cut plane so as to correspond to the other end of the concave portion.

BACKGROUND OF THE INVENTION

In general, a key ring is to take charge of various types of keys more conveniently. The key ring is fabricated by winding a metal bar of a small diameter so as to be folded double, with its circumference maintained constantly. Such a key ring will be more fully described with reference to accompanying drawings.

FIG. 1 is a perspective view of a conventional key ring, and FIG. 2 is a front view of the key ring illustrated in FIG. 1.

As illustrated in FIGS. 1 and 2, a ring body 100 of a key ring has a relatively less diameter and is fabricated using a metal rob of a predetermined length.

With the ring body 100, a curved portion 200 is formed at a predetermined place of the ring body 100, and cut planes 110 are formed at both ends of the ring body 100, respectively.

And, if the ring body 100 is wound centering around the curved portion 200 of the ring body 100 so as to be folded double, with its ring shape maintained, the cut planes 110 are close to both upper and lower sides of the curved portion 200, respectively. Thus a key 300 is inserted through a space between the ring body 100 and each cut plane 110.

That is, if the ring body 100 of a predetermined length is wound and double folded without change of its ring shape, the cut planes 110 thereof are placed at upper and lower sides of the curved portion 200, respectively. In order to keep or take out the key 300, a user opens a space between the ring body 100 and one cut plane 110 and then inserts the key 300 through the opened space by force.

According to the above-described key ring, the ring body 100 is formed by a metal rob without increase of its diameter and length, the curved portion 200 is formed at a predetermined place of the ring body 100, and the ring body 100 is wound centering around the curved portion 200 so as to be folded double without change of its ring shape. As a result, the ring body 100 is formed without change of its ring shape. At this time, the cut planes 110 are close to the upper and lower sides of the curved portion 200.

In this state, if a user opens a space between the curved portion 200 and one cut plane 110 by force (e.g., using own fingernail), the cut plane 110 is widened toward an outer side, and the key 300 is inserted through the opened part.

In order to take out the key 300 from the ring body 100 of the key ring, the user widens a space between the curved portion 200 and the cut plane 110 by force (e.g., using own fingernail), and then takes out the key 300 from the ring body 100.

A problem of the conventional key ring, however, is that user's fingernail easily gets hurt when providing a space between the curved portion and the cut plane by force to insert and take out the key.

SUMMARY OF THE INVENTION

It is an object of this invention to provide a key ring for making it easy to keep and take out a key by less force and preventing hurt of a user.

In order to obtain a foregoing object, a key ring is provided which includes a ring body having cut planes at both ends and keeps a key. In the key ring, a concave part is bent toward one side in a body with the ring body and is formed at a predetermined place of the ring body. One of the cut planes is projected toward an inner side of the concave part. The key is inserted by use of the projected cut plane.

DETAILED DESCRIPTION OF THE PREFERRED EMBODIMENTS

A preferred embodiment of the present invention will be more fully described below with reference to accompanying drawings.

Figure 1:
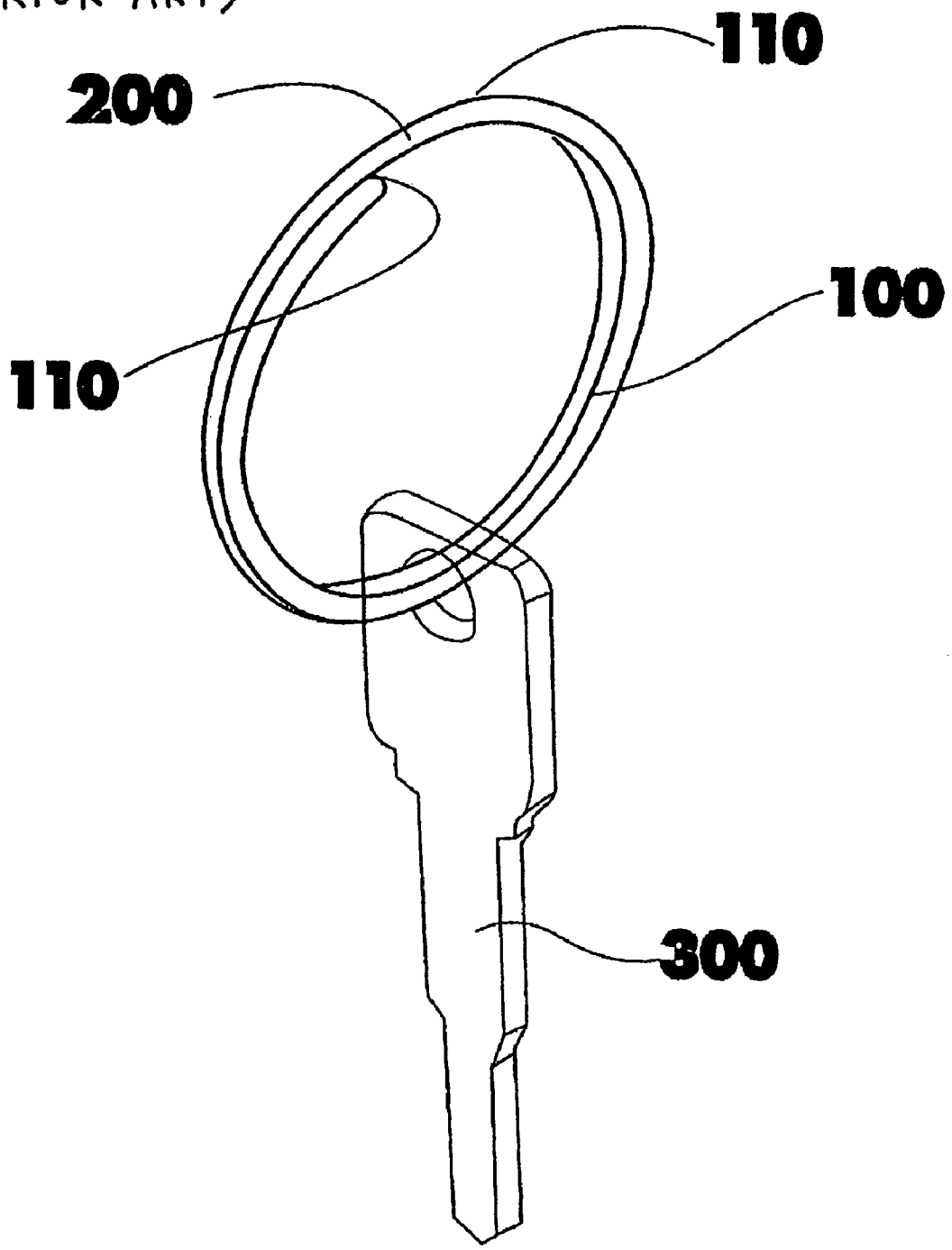
FIG.1 (PRIOR ART)
FIG. 1 is a cross-sectional view of a convention key ring.
Figure 2:
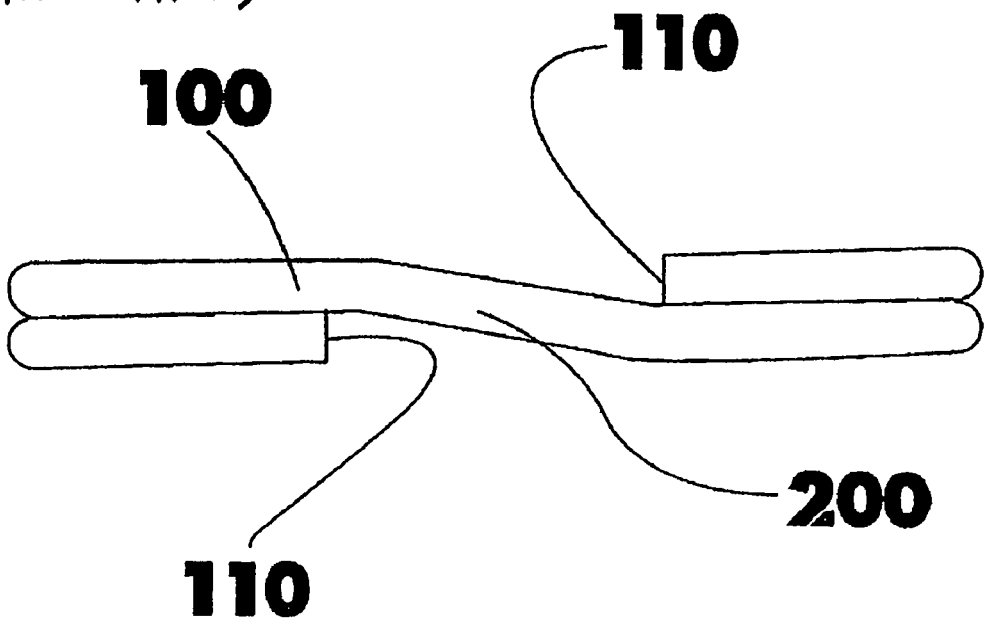
FIG. 2 (PRIOR ART)
FIG. 2 is a front view of a key ring in FIG. 1.
Figure 3:
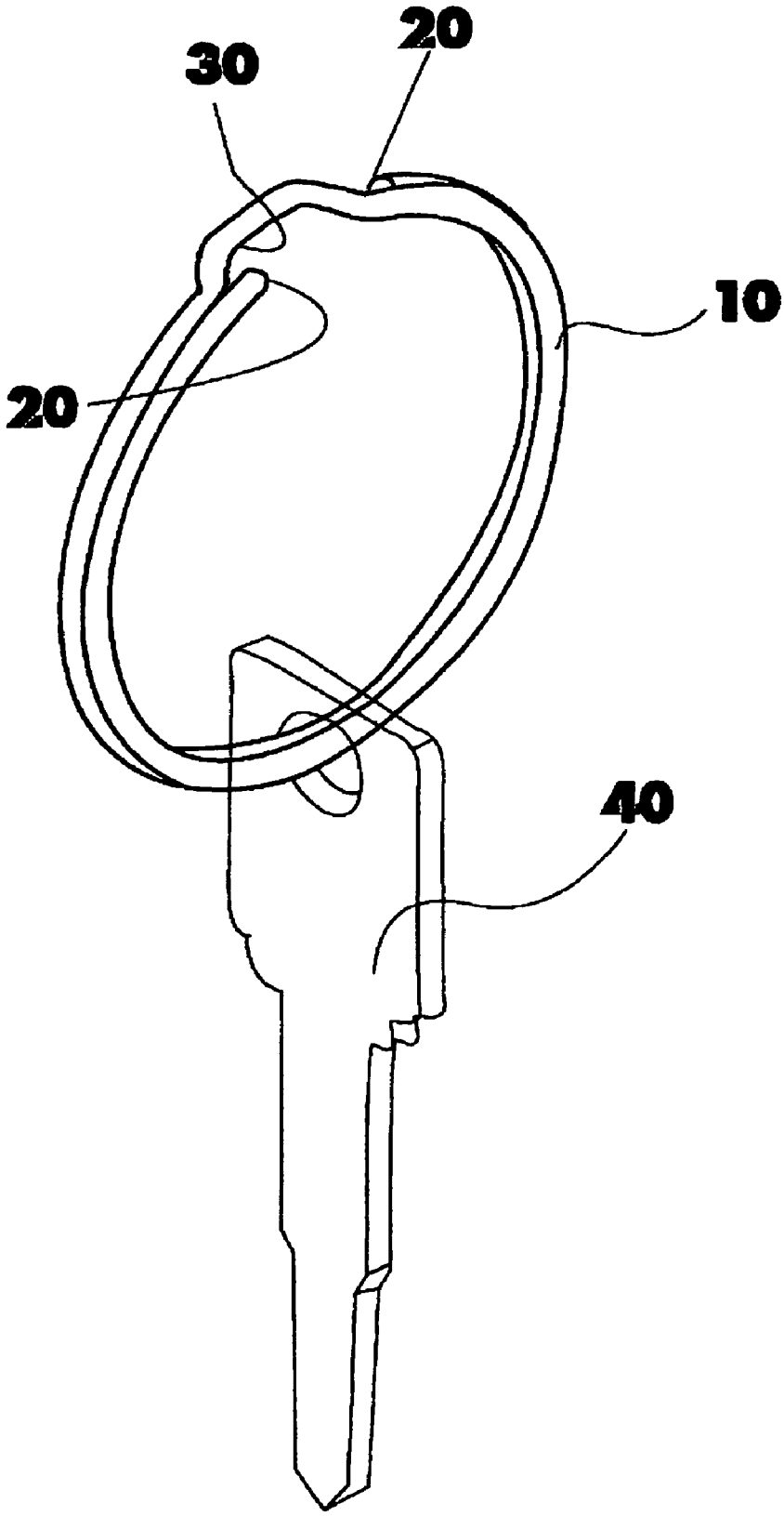
FIG. 3 is a cross-sectional view of a key ring according to the present invention.
Figure 4:
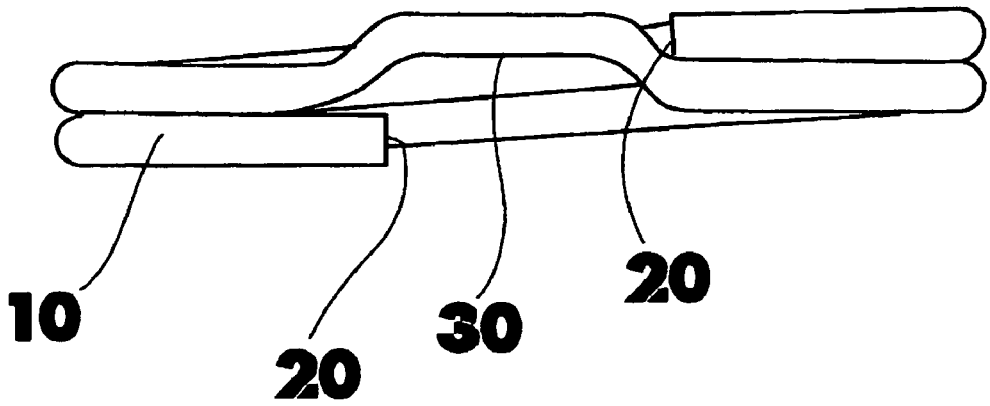
FIG. 4 is a front view of a key ring in FIG. 3.
Figure 5A:
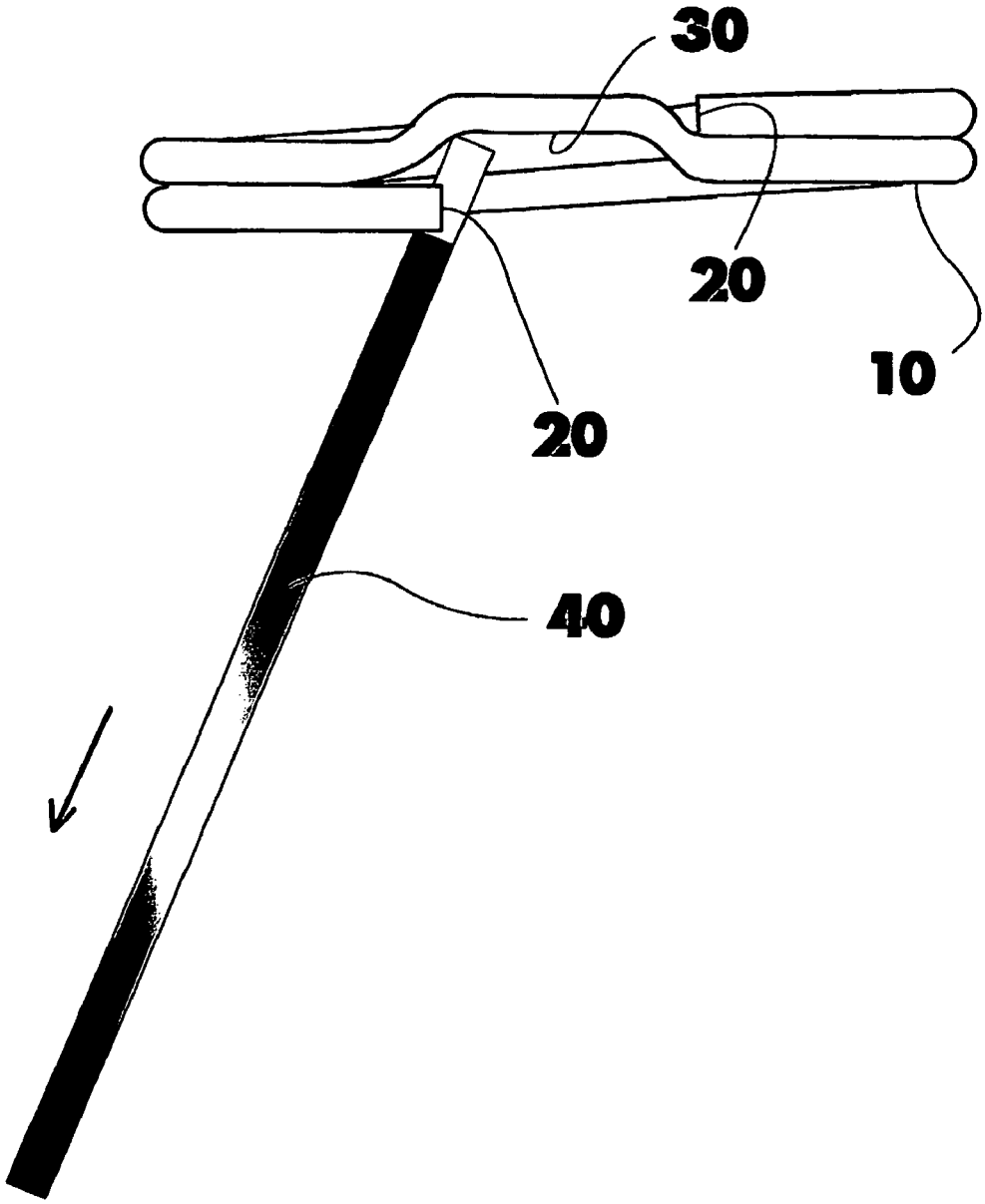
FIGS. 5A and 5B are schematic diagrams of a key ring according to the invention when keeping and taking out a key.
Figure 5B:
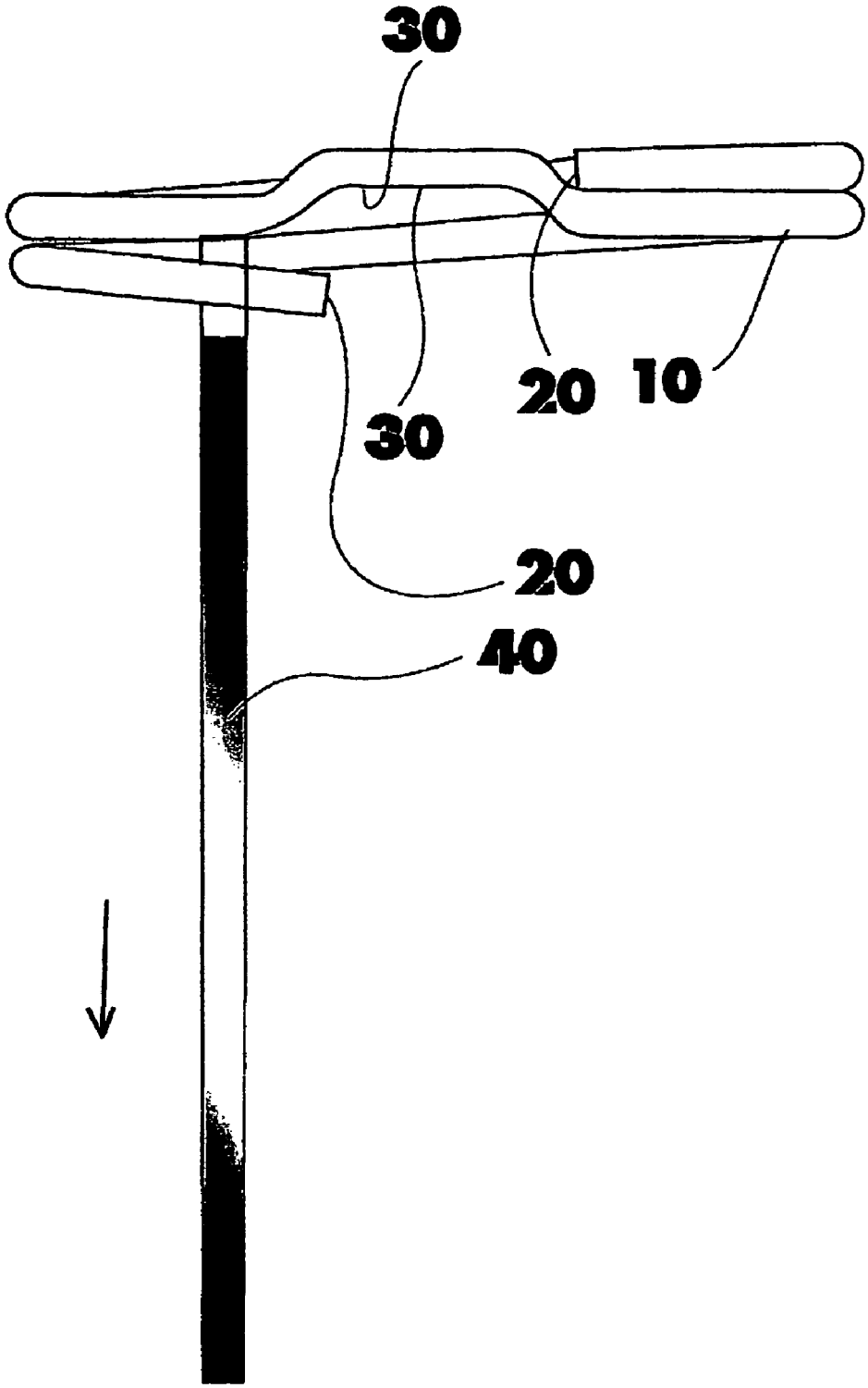

FIG. 3 is a perspective view of a key ring according to the present invention, FIG. 4 is a front view of a key ring in FIG. 3, and FIGS. 5A and 5B are schematic diagrams of a key ring according to the invention when keeping and taking out a key.

As illustrated in FIGS. 3 and 4, a key ring of the present invention includes a ring body 10, which is made of a metallic material and has a relatively small diameter and a predetermined length.

The ring body 10 has a concave part 30 that is bent toward one side and is formed at a predetermined place of the ring body 10. Cut planes 20 are formed at both ends of the ring body 10.

The wire (that is, one continuous wire having two ends 20, 20) as shown in FIG. 3 is wound to form a key ring (or more generally a key holder) having a ring body 10 and a concave part 30 which is curved to provide first space between the two wire ends 20, 20. FIG. 3 shows the wire wound along the perimeter of a geometric shape which is circle in this embodiment of the present invention. This wire wound in a circle shape is the ring body 10 as shown in FIG. 3. The ring body 10 has a first perimeter part and a second perimeter part. The second perimeter part is denoted with numeral 30. The other part of the ring body 10 is the first perimeter part. The first perimeter part has 2 wire portions contiguously placed to each other. The second perimeter part 30 has 1 wire portion (or one less wire portion than the number of wire portions in the first perimeter part). As discussed above, the first and second perimeter parts are formed by one continuous wire wound to form the ring body 10. The second perimeter part 30 has one less wire portion than the first perimeter part, because the two ends 20, 20 of the wire are not wound to a complete circle. The wire in the second perimeter part or the concave part 30 is bent away from the contour of the ring body 10 as shown in FIG. 3 such that at least one of the wire ends 20 does not touch the wire in the concave part 30. The second space between the wire end 20 and the wires in the concave part 30 allows easy insertion of a key 40 into the key holder according to an embodiment of the present invention. That is, at least one of two wire ends 20, 20 protrudes into the second perimeter part without touching the wire portion in the second perimeter part as shown in FIG. 3. The second space formed between protruding wire end and the wire portion in the second perimeter part together with the first space allow easy insertion of a key 40 into the ring body 10.

To summarize while referring to FIGS. 3–4 and 5A–5B, a wire having first and second wire ends 20, 20 is wound to form the key holder 10 having a first perimeter part and a second perimeter part 30. The part of the key holder 10 excluding the second perimeter part 30 is the first perimeter part. The first perimeter part has the X number of wire portions contiguously placed to each other. In FIGS. 3–4 and 5A–5B, X equals 2. The second perimeter part 30 has X−1 number of wire portions contiguously placed to each other. In FIGS. 3–4 and 5A–5B, X−1 equals 1. The X number of wires in the first perimeter part (X=2) are wound along the contour of a three dimensional geometric shape, which is shown as a circle in the drawings. The one wire portion (i.e., X−1) of the second perimeter part 30 is now wound along the three dimensional contour of the geometric shape but are bent away from the dimensional contour of the geometric or circle shape of the two (i.e., X) wire portions in the first perimeter part. A predetermined length of the wire connected to the second wire end protrudes into the second perimeter part without touching the X−1 number of contiguous wire portions forming a space between the second wire end and the X−1 number of wires in the second perimeter part, and the space between one of the wire ends and the X−1 number of contiguous wire portions allow easy insertion of a key into the key holder.

That is, if the ring body 10 of the predetermined length is wound without change of its ring shape so as to be folded, one cut plane 20 is projected toward an inner side of the concave part 30 and the other cut plane 20 becomes close to an outer side of the concave part 30. At this time, it is preferred that the one cut plane 20 is projected with a minimum length.

According to the key ring of the present invention, the ring body having predetermined diameter and length, the concave part 30 is formed at a predetermined place of the ring body 10, and the ring body 10 is wound without change of its ring shape. This makes the ring body 10 formed without change of its ring shape. At this time, the cut planes 20 are close to the inner and outer sides of the concave part 30, respectively. That is, one cut plane 20 is projected toward an inner side of the concave part 30 and the other cut plane 20 is close to an outer side of the concave part 30.

In this state, as illustrated in FIGS. 5A and 5B, a key 40 is inserted into the cut plane 20 projected toward the inner side of the concave part 30, and then the projected cut plane 20 is, put out to an outer side. The key 40 is entirely inserted and kept by shifting the key 40 along an outside diameter of the cut plane 20.

At this time, by minimizing a projected length of the cut plane 20, it is possible to minimize hooking of the projected cut plane at user's clothing. And, to put out the key 40 from the ring body 10 of the key ring, the key 40 is inserted into the projected cut plane 20 and is drawn inside. Thus the key 40 is easily separated from the ring body 10.

INDUSTRIAL APPLICABILITY

By the key ring according to the present invention, a concave part is formed at a predetermined place of a ring body made of a metal material. The ring-shaped body is formed such that one cut plane at one end of the ring body is projected to an inner side of the concave part and the other cut plane corresponds to an outer side of the concave part. It is easy to keep and take out a key through the projected cut plane by less strength.

The invention claimed is:

1. A key holder comprising:

a wire having a first wire end and a second wire end and wound to form the key holder having a first perimeter part and a second perimeter part; and a concave part formed between both the wire ends to provide a first space to allow easy insertion of a key into the key holder, wherein the first perimeter part of the key holder has an X number of wire portions contiguously placed to each other, wherein the second perimeter part of the key holder has a X−1 number of wire portions contiguously placed to each other, wherein the X number of wire portions in the first perimeter part are wound along the three dimensional contour of a geometric shape including a circle;

wherein the X−1 number of wire portions of the second perimeter part are not wound along the same three dimensional contour of the geometric shape of the X number of wire portions in the first perimeter part, and wherein a predetermined length of the wire connected to the second wire ends protrudes into the second perimeter part along the same three dimensional contour of the geometric shape without touching the X−1 number of contiguous wire portions of the second perimeter part to form a second space between the second wire end and the X−1 number of contiguous wire portions of the second perimeter part, and the second space between the second wire end and the X−1 number of contiguous wire portions of the second perimeter part allows easier insertion of a key into the key holder together with the first space provided by the concave part.

* * * * *